US007117883B1

(12) United States Patent
Vitalo

(10) Patent No.: US 7,117,883 B1
(45) Date of Patent: Oct. 10, 2006

(54) VALVE KEY ALIGNMENT ASSEMBLY FOR CURB STOP BOX

(75) Inventor: Angelo R. Vitalo, Newark, DE (US)

(73) Assignee: VKAD Products, LLC, Newark, DE (US)

( * ) Notice: Subject to any disclaimer, the term of this patent is extended or adjusted under 35 U.S.C. 154(b) by 0 days.

(21) Appl. No.: 11/324,676

(22) Filed: Jan. 3, 2006

(51) Int. Cl.
*F16L 5/00* (2006.01)

(52) U.S. Cl. ..... 137/366; 137/367; 137/369; 137/371

(58) Field of Classification Search ..... 137/365, 137/366, 367, 368, 369, 370, 371
See application file for complete search history.

(56) References Cited

U.S. PATENT DOCUMENTS

| | | | | | |
|---|---|---|---|---|---|
| 996,596 | A | * | 6/1911 | Walcott | 37/434 |
| 1,108,031 | A | | 8/1914 | Tyler | |
| 2,099,479 | A | * | 11/1937 | Heinkel et al. | 137/367 |
| 2,691,384 | A | * | 10/1954 | Mueller et al. | 137/366 |
| 4,030,519 | A | | 6/1977 | Zinn | |
| 4,239,056 | A | | 12/1980 | Shope | |
| 4,308,886 | A | | 1/1982 | Handley | |
| 4,333,494 | A | | 6/1982 | Shope | |
| 4,534,378 | A | * | 8/1985 | Gagas et al. | 137/367 |
| 4,556,081 | A | * | 12/1985 | Gagas | 137/366 |
| 4,572,236 | A | | 2/1986 | Baker | |
| 4,691,733 | A | | 9/1987 | Zinn | |
| 4,819,687 | A | * | 4/1989 | Alberico et al. | 137/367 |
| 4,905,725 | A | | 3/1990 | Sinkinson | |
| 5,327,925 | A | * | 7/1994 | Ortel | 137/15.08 |
| 5,394,898 | A | | 3/1995 | Turner | |
| 5,730,180 | A | | 3/1998 | Alberico | |
| 5,738,140 | A | | 4/1998 | Mann | |
| 5,871,030 | A | | 2/1999 | Agbay | |
| 5,950,654 | A | | 9/1999 | Paylor | |
| 5,983,925 | A | | 11/1999 | Miller | |
| 6,202,675 | B1 | | 3/2001 | Forte | |

* cited by examiner

*Primary Examiner*—A. Michael Chambers
(74) *Attorney, Agent, or Firm*—E. Alan Uebler, PA

(57) ABSTRACT

A self-aligning curb box assembly is provided. The curb box includes a cylindrical conduit extending from the ground surface downwardly and has a detachable cover at its upper, surface end. The conduit has an inverted "U" shaped passageway formed at its lower end through which a generally horizontally oriented supply line, such as for water or gas, passes. The supply line has a valve body and an "open-to-shut" valve cock located in the line positioned within the passageway at the lower end of the curb box, the valve cock extending upwardly. The assembly includes a positioning insert placed within the curb box at its lower end thereof. The insert limits lateral movement of the valve body in any direction throughout 360° in the plane about the valve when the insert is installed. The insert prevents substantial movement, both laterally and vertically, of the valve body relative to the curb box, thereby permitting ease of access to the valve cock by a valve key extending through the curb box to the valve to turn the valve off (or on). Also provided are the curb box alignment insert itself and a method of its use in aligning the curb box and valve in order to gain access by a valve key from ground level to the valve cock in said buried valve.

30 Claims, 3 Drawing Sheets

VALVE KEY ALIGNMENT ASSEMBLY FOR CURB STOP BOX

BACKGROUND OF THE INVENTION

The invention relates to a protective, hollow, elongated housing, known in the industry as a curb box, which extends generally from a utility supply valve for a water or gas line buried in the ground, the curb box extending upwardly to the ground surface.

Gas or water mains, which supply residential or commercial buildings and which extend along and are buried under streets and roads running past the buildings, are connected from the main to each building by individual service lines, wherein the main and the service lines all extend below the frost line in the respective areas being served. Each service line is provided with a shut-off valve assembly, typically located near the curb of the street or road, or otherwise near the main supply line, hence the name "curb box". The assembly generally includes a housing disposed about the valve and a tubular, vertically oriented conduit, typically 4" to 8" in diameter, extending from the buried valve housing upwardly to the ground surface, having a cover or lid thereat removably secured to the conduit. This assembly effectively protects the underground valve from the environment and unauthorized access thereto.

To turn the supply of gas or water to an individual building on or off, the cover is removed and a tool, termed a "key", being a long rod with a slot or fork at its lower extremity, is inserted at the surface opening into the tubular conduit. The key extends downwardly to the head of the valve stem whereat, in theory, the key engages the valve cock and the valve stem is rotated 90° about its vertical axis to turn the gas or water supply to the building off (or on, as the case may be).

Problems associated with conventional curb boxes are well known. Ground in which valves are initially located may be disturbed, such as for backfills in new housing developments. Continuous variations in temperature can cause expansion and contraction of both the ground and the valve and piping. Repeated freezing and thawing can displace the valve substantially out of alignment with the curb box cover and the housing assembly. Soil erosion, water seepage, vehicles driving over the surface above the valve and other, similar forces can all cause the valve to move out of alignment with the access port at the surface, thereby making it difficult or impossible to reach the valve stem with the valve key. If the valve stem is not perfectly upright, it often cannot be opened. When the valve can not be opened by the key, the only available alternative is to excavate, and dig down to the valve itself, locate it, and shut it off. This can be a relatively very expensive operation.

Many prior patents have issued which purportedly address and solve this valve misalignment problem inherently associated with conventional curb boxes. Among these are U.S. Pat. Nos. 5,327,925; 4,572,236; 4,691,733; and the patents set out on the Invention Disclosure Form submitted simultaneously with the original application for this patent. None of these prior patents, nor any of the references cited within them, either discloses or suggests, either alone or in any combination, the features or advantages of the valve key alignment assembly presented hereinbelow.

While each of these prior patents purports to address and solve the curb box valve alignment problem, none provides the advantages, both in achieving mechanical alignment between key and valve stem and extremely low cost, provided by the invention disclosed and claimed herein.

SUMMARY OF THE INVENTION

A self-aligning curb box assembly is provided. The curb box includes a cylindrical conduit extending from the ground surface downwardly and has a detachable cover at its upper, surface end. The conduit has an inverted "U" shaped passageway formed at its lower end through which a generally horizontally oriented supply line, such as for water or gas, passes. The supply line has a valve body and an "open-to-shut" valve cock located in the line positioned within the passageway at the lower end of the curb box, the valve cock extending upwardly. The assembly includes a positioning insert placed within the curb box at its lower end thereof. The insert has an upper, horizontally disposed plate having a central circular opening extending therethrough, the opening diameter being sized to accommodate the valve body extending therethrough to a desired tolerance therebetween, so as to limit lateral movement of the valve body in any direction throughout 360° in the plane about the valve when the insert is installed. The insert has at least two vertically oriented legs extending from its upper plate downwardly such that, when installed, these legs straddle the supply line and valve body. Each of the legs of this insert has a foot member extending radially outwardly and, when installed, each foot member is positioned under the lowermost end of the curb box and is held in place thereat by the curb box.

When installed, the insert prevents substantial movement, both laterally and vertically, of the valve body relative to the curb box, thereby permitting ease of access to the valve cock by a valve key extending through the curb box to the valve.

The cylindrical conduit may have at least two sections adjustably moveable one with respect to another, more specifically, two sections, a top section and a bottom section, wherein the bottom section is threaded externally and the top section has internal, mating threads along at least a portion of its length, and includes a flange at its top thereof to mate with and detachably receive and secure the cover.

The plate may include a plurality of openings therethrough spaced about its periphery and between the outer diameter of the central circular opening and the outer edge thereof, to effect drainage therethrough. The insert is preferably fabricated of plastic such as ABS plastic, PVC, or a fluorocarbon plastic such as PTFE or FEP. The insert is preferably fabricated as a single, unitary component, including its upper plate, legs and feet, such as by injection molding.

Also provided are the curb box alignment insert substantially as described hereinabove, and a method of its use in aligning the curb box and valve in order to gain access by a valve key from ground level to the valve cock in said buried valve.

BRIEF DESCRIPTION OF THE DRAWINGS

In the accompanying drawings.

DETAILED DESCRIPTION OF THE INVENTION AND PREFERRED EMBODIMENTS WITH REFERENCE TO THE DRAWINGS

A self-aligning curb box assembly is provided. The curb box includes a cylindrical conduit extending from the ground surface downwardly and has a detachable cover at its upper, surface end. The conduit has an inverted "U" shaped passageway formed at its lower end through which a generally horizontally oriented supply line, such as for water or gas, passes. The supply line has a valve body and an "open-to-shut" valve cock located in the line positioned within the passageway at the lower end of the curb box, the valve cock extending upwardly. The assembly includes a positioning insert placed within the curb box at its lower end thereof. The insert limits lateral movement of the valve body in any direction throughout 360° in the plane about the valve when the insert is installed. The insert prevents substantial movement, both laterally and vertically, of the valve body relative to the curb box, thereby permitting ease of access to the valve cock by a valve key extending through the curb box to the valve to turn the valve off (or on). Also provided are the curb box alignment insert itself and a method of its use in aligning the curb box and valve in order to gain access by a valve key from ground level to the valve cock in said buried valve.

Figures 1, 1A:
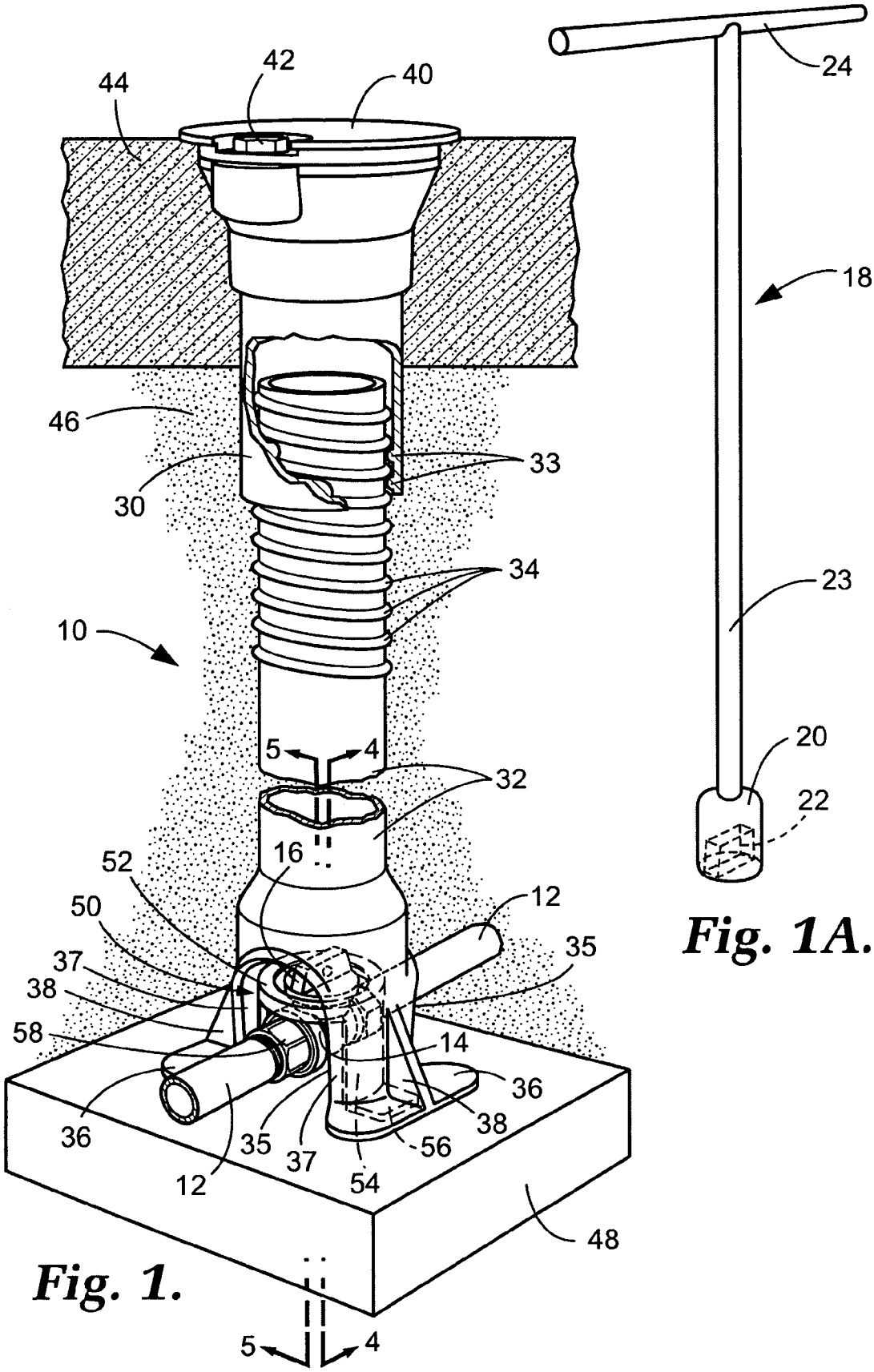
FIG. 1 is a perspective view of all components of a curb box assembly installed and in place, including the alignment insert according to the invention.
FIG. 1A shows a conventional valve "key" tool used to turn the valve cock to an "on" or "off" position.

A detailed description of the invention and preferred embodiments is best provided with reference to the accompanying drawings wherein FIG. 1 depicts, in perspective, the entire curb box with alignment assembly, 10, installed in the ground over a service line 12, such as a water or gas supply line, having a shut-off valve 14 installed therein, as shown. Valve 14 has valve cock 16 extending therefrom, which opens or closes the valve by turning, using a tool such as the valve key 18 shown in FIG. 1A. The valve key 18 has an end socket 20 with slot 22 (in phantom) which slot is sized to accept the valve cock 16 therein. The bit 20 is affixed to the distal end of rod 23, which rod 23 has, at its proximal end, a turning handle 24 affixed thereto.

Returning to FIG. 1, curb box 30, 32 has separate mating upper portion 30, with internal thread 33, and lower portion 32, having external thread 34, which, together, provide a vertically oriented, length adjustable conduit extending from the ground surface, 44, downwardly, to the utility line 12. The lower end of conduit 32 flares outwardly as shown, into a bell shaped end portion which has two leg members 37, which straddle the service line 12 and valve body 14, the line and body passing through the opening 35 through the lower end of conduit 32, all as shown. The bell shaped end of conduit 32 may rest on a concrete block 48 or on the ground itself, or other suitable foundation. The bell end generally has supporting feet 36 on which it rests, and supporting and stabilizing grunions 38. The upper portion 30 of the curb box conduit, threadingly mated to the lower portion 32 to permit vertical adjustment, as needed, extends upwardly to the ground surface 44, where a detachable cover 40 is affixed thereto by means of bolt 42, to permit access to and through the conduit to the valve 14.

The surface 44 is depicted as a road surface, which may be concrete or asphalt or other surface. Fill dirt such as clay or other fill material 46 is used to fill and pack the earth surrounding the curb box as shown. Generally, materials of construction for these components 30, 32 and 40 have included cast iron and some forms of plastics, notably PVC and ABS, and any suitable, long lasting, conventional rugged material of construction may be employed in the curb box of the invention.

As discussed above and also extensively in the prior art, a problem long associated with conventional curb boxes is that of shifting of the utility line in the ground below the access opening at the surface, whether transversely or vertically, causing displacement of the valve cock 16 such that it is impossible to reach by valve key 18. When that happens, the only alternative is to excavate down to the utility line and valve, perform the shut off and repair, and reconstruct the road and fill location to restore it to original condition. This is an expensive proposition, at the least, causing inconvenience and time delay.

To obviate this problem, the curb box of this invention includes the alignment assembly as shown in FIG. 1, including an insert 50, having an upper, generally horizontally disposed top plate, 52, the plate having a central circular opening 53 therethrough, which opening is sized so as to accommodate valve body 14 and valve cock 16 extending therethrough to a specified tolerance, generally ⅛ to ¼ inch, so as to limit lateral movement of the valve body transversely through 360° in any direction in the plane about the valve.

Insert 50 includes at least two legs 54 extending from the upper plate 52 downwardly, the legs 54 straddling the valve body 14, with each leg 54 having a "foot" 56 extending radially outwardly therefrom such that, when installed as shown, each foot member is positioned under a foot 36 of the curb box conduit 32. This insert thus restricts the lateral movement of the valve 14 to the tolerance between the valve body 14 and the I.D. of the circular opening 53, i.e., to ⅛ to ¼ inch, if desired. Vertical displacement of the valve body 14 is restricted by the insert 50 being essentially clamped in place by the insert feet 56 and held thereat by feet 36 of the curb box conduit.

Materials of construction for insert 50 may include any suitable material which will withstand service conditions. Plastics are preferred, TEFLON® polytetrafluoroethylene being most preferable. Other suitable plastics would include PVC and ABS. Various sizes of inserts can be made available for use in the various standard size curb boxes. And the inserts 50 can be constructed of component pieces machined independently and glued or welded together, or, more preferably, the inserts 50 can be molded as a one-piece, unitary structure. For melt processable plastics, this can be done by injection molding.

Assembled, the curb box assembly of the invention allows for ease of alignment of a valve key 18 with an underground valve cock 16 through a curb box conduit, thereby providing ready access to the valve for purposes of shutting it off or turning it on, and the assembly maintains alignment of valve body with respect to the access conduit indefinitely, through all expected and even most unforeseen ground shifts.

Figure 2:
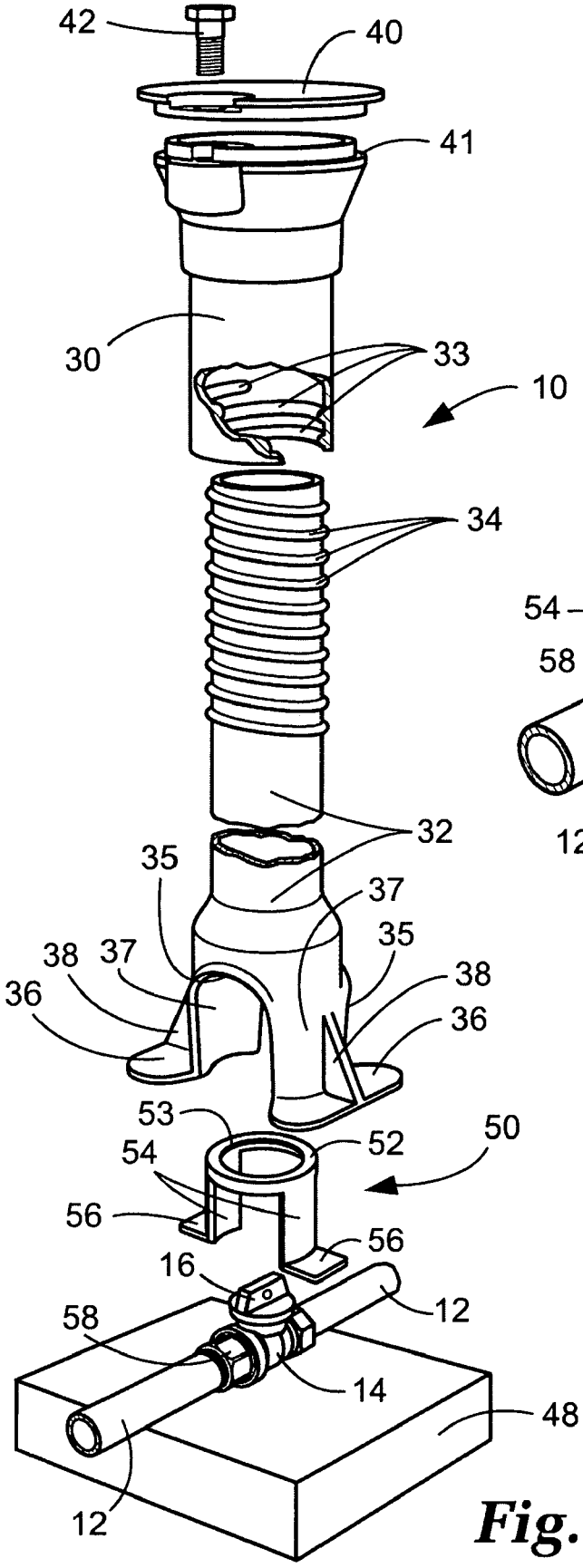
FIG. 2 is an exploded view of the components of the invention, in a disassembled configuration, to illustrate the various components in greater detail.

FIG. 2 depicts, in an exploded perspective view, the several components that comprise the curb box assembly of the invention. Specifically, the upper portion 30 of the curb box conduit, having internal thread 33 and cover 40, secured by bolt 42, screws onto the lower curb box conduit portion 32, shown in the figure as broken to indicate an indefinite length, which length can be sized for the job at hand, the conduit 32 having external threads 34 which mate with the threads on upper conduit 30, adjustment of which provides for vertical height adjustment of the apparatus between the valve 14 and the ground surface, cover 40 being flush therewith.

The lower conduit 32 flares outwardly at its lower end into legs 37 which straddle the valve 14 and pipe 12, which are housed under and pass through the inverted "U" shaped passageway 35 through conduit 32. The lower conduit 32 rests on outwardly extending feet 36 supported by grunions 38 with the entire assembly being supported, for example, on a concrete block 48. Integral to the invention is the alignment insert 50 which is placed within the opening 35 in the lower conduit, which insert has legs 54 extending from its annular top plate 52, circular as shown in top plan in this embodiment, downwardly to outwardly extending feet 56, as shown. When installed, feet 56 are positioned between the foundation block 48 and the feet 36 of upper cylinder 32. In this way, the insert 50, having circular opening 53 extending through top plate 52, with the top plate itself fitting generally to tolerance over the valve 14 and valve cock 16, restricts the transverse movement of valve 14 and valve cock 16 through 360° when the insert is installed and in place, and vertical movement of the valve 14, relatively with respect to the curb box 32, is substantially eliminated owing to the insert feet 56 being held in place and restrained thereat by the feet 36 of conduit 32.

Figure 3:
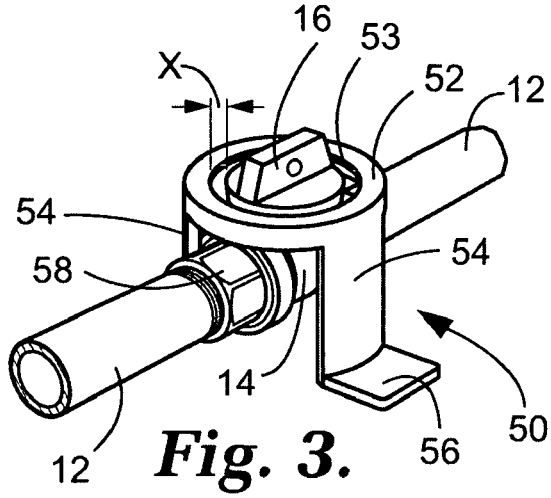
FIG. 3 is a perspective view of one embodiment of the alignment insert according to the invention, in place and installed over a valve.

A perspective view of the relative positioning of the insert 50 and valved pipe 12 is shown in FIG. 3. The insert 50 is fitted such that the valve 14 with valve cock 16 protrudes through the opening 53 in the insert top plate 52, and the tolerance (gap spacing) between the valve 14 housing and the I.D. of opening 53 in plate 52 may be sized as desired, typically being in the range ⅛ inch to ¼ inch, shown as "X" in FIG. 3, thereby limiting transverse movement of valve 14 in any direction to the tolerance selected. As discussed above, insert 50 is preferably plastic, most preferably a molded, unitary plastic insert, and a fluorocarbon plastic such as polytetrafluoroethylene (PTFE) or a fluorinated ethylene propylene (FEP) is preferred. For some applications, plastics such as PVC or ABS or other resins may be employed. In FIG. 3, connector 58 is shown and included for completeness of illustration. Pipe 12 may be a water supply line or a gas supply line or any other line which may be subjected to underground displacement and which requires access thereto from the surface via a curb box assembly.

Figure 4:
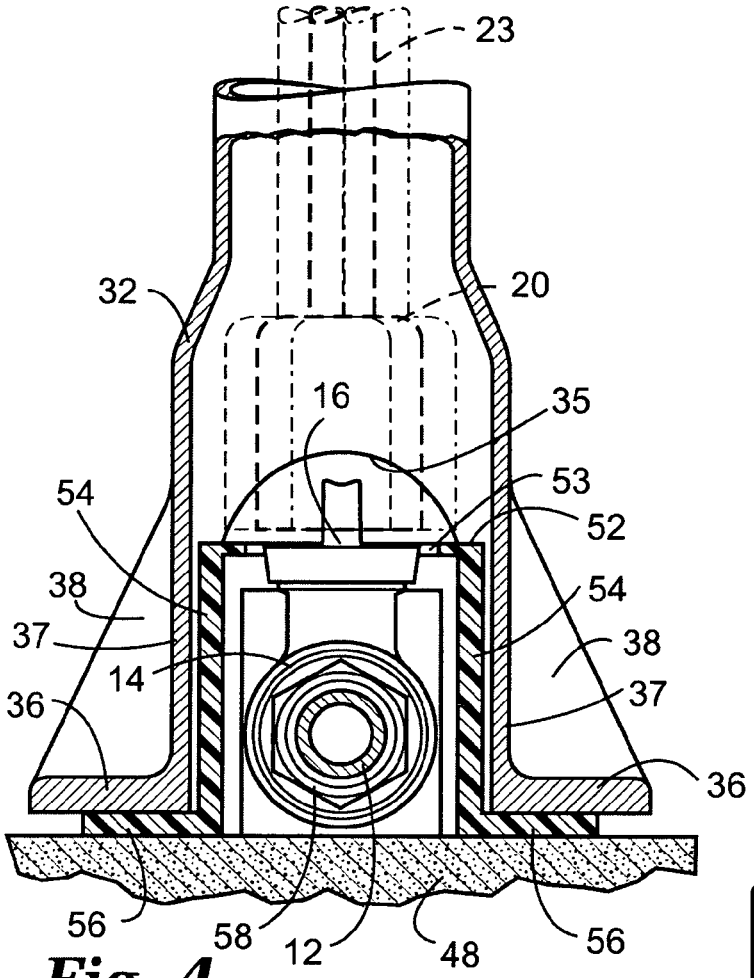
FIG. 4 is an end cross-sectional view of the curb box assembly taken substantially along line 4—4 of FIG. 1, wherein the maximum displacements possible for the valve key are shown in dashed lines.

FIG. 4 is a cross-sectional view taken substantially along line 4—4 of FIG. 1. In this figure, the socket 20 affixed to the distal end of rod 23 of the valve key 18 is shown in phantom in potentially different transverse positions possible for the socket. The insert 50 having top plate 52 and opening 53 as discussed above, is sized so as to provide a gap, indicated by "X" in FIG. 3 and visible in FIG. 4, of the specified, desired tolerance discussed above, typically ⅛ inch. It can be seen from this figure that within this tolerance the valve cock 16 can be easily reached and engaged by the valve key socket 20 at any displacement of the valve 14 with respect to the curb box assembly. Components shown in FIG. 4 are as described previously.

Figure 5:
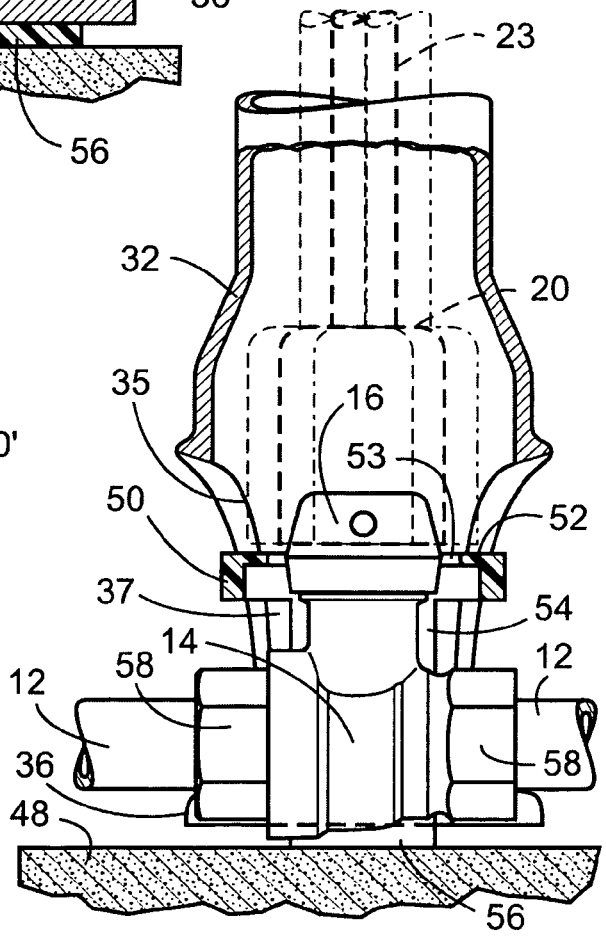
FIG. 5 is a side cross-sectional view of the assembly taken along line 5—5 of FIG. 1, also depicting in phantom the limited range of possible valve key displacements according to the invention.

FIG. 5 depicts a cross-sectional view of the assembly taken substantially along line 5—5 of FIG. 1, wherein the components are as described above. Any displacement of pipe 12, valve 14 and valve cock 16 along the direction of the pipe 12 is similarly restricted to the selected tolerance "X" designed into the system. At all possible displacements, the valve cock 16 is readily accessible by valve key socket 20, again the available movement of which is illustrated in phantom.

Figure 6:
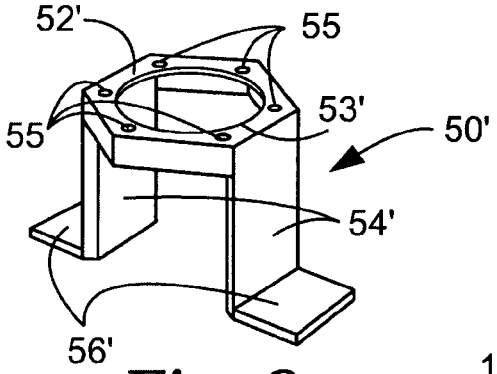
FIG. 6 is a perspective view of one alternate embodiment of the curb box insert of the invention wherein the insert, in top plan view, has a hexagonal configuration.

FIG. 6 shows an alternate embodiment of an insert 50', which falls within the scope of the claims appended hereto. In this embodiment, the individual components corresponding to those of FIGS. 1 and 2 are differentiated by use of primes. This figure illustrates that inserts 50', having other than externally circular top plates 52 of FIG. 1, such as the hexagonal shape 52' of FIG. 6 may be used, as can octagonal and other shapes. Also shown in FIG. 6 are drain holes 55, which may be included in any of the inserts 50, 50', etc., described and claimed, if needed or desired.

While the invention has been disclosed herein in connection with certain embodiments and detailed descriptions, it will be clear to one skilled in the art that modifications or variations of such details can be made without deviating from the gist of this invention, and such modifications or variations are considered to be within the scope of the claims hereinbelow.

What is claimed is:

1. A self-aligning curb box assembly comprising:

a curb box, being a cylindrical conduit extending from the ground surface downwardly, having a detachable cover at its upper, surface end, and having an inverted "U" shaped passageway formed at its lower end through which a generally horizontally oriented supply line, such as for water or gas, passes, said supply line having a valve body and an "open-to-shut" valve cock located in said supply line and positioned within said passageway at the lower end of said curb box, the valve cock extending upwardly, the assembly including a positioning insert placed within the curb box at its lower end thereof, said insert comprising an upper, horizontally disposed plate having a central circular opening extending therethrough, said opening diameter sized to accommodate said valve body extending therethrough to a desired tolerance therebetween, so as to limit lateral movement of said valve body in any direction throughout 360° in the plane about said valve when said insert is installed, the insert having at least two vertically oriented legs extending from said upper plate downwardly such that, when installed, said legs straddle said supply line and valve body, wherein each of said legs has a foot member extending radially outwardly and, when installed, each foot member is positioned under the lowermost end of said curb box and is held in place thereat by said curb box, wherein, when installed, said insert prevents substantial movement, both laterally and vertically, of said valve body relative to said curb box, thereby permitting ease of access to said valve cock by a valve key extending through said curb box to said valve.

2. The assembly of claim 1 wherein said cylindrical conduit comprises at least two sections adjustably moveable one with respect to another.

3. The assembly of claim 2 wherein said conduit comprises two sections, a top section and a bottom section, wherein said bottom section is threaded externally and said top section has internal, mating threads along at least a portion of its length which mate with the bottom section threads, the top section having a flange at its top thereof to mate with and detachably receive and secure said cover.

4. The assembly of claim 1 wherein said plate has a plurality of openings therethrough spaced about its periphery and between the central circular opening and the outer edge thereof, to effect drainage therethrough.

5. The assembly of claim 1 wherein said insert has more than two legs.

6. The assembly of claim 1 wherein said insert is fabricated of plastic.

7. The assembly of claim 6 wherein said plastic is ABS plastic.

8. The assembly of claim 6 wherein said plastic is PVC.

9. The assembly of claim 6 wherein said plastic is a fluorocarbon plastic.

10. The assembly of claim 9 wherein said plastic is PTFE.

11. The assembly of claim 9 wherein said plastic is FEP.

12. The assembly of claim 1 wherein said insert is fabricated as a single, unitary component, including said upper plate, legs and feet.

13. The assembly of claim 12 wherein said insert is injection molded.

14. The assembly of claim 1 wherein the perimeter of said plate is circular in top plan view.

15. The assembly of claim 1 wherein the perimeter of said plate is hexagonal in top plan view.

16. A self-aligning curb box assembly comprising:

a curb box being a cylindrical conduit extending from the ground surface downwardly, having a detachable cover at its upper, surface end, and having an inverted "U" shaped passageway formed at its lower end through which a generally horizontally oriented supply line, such as for water or gas, passes, said supply line having a valve body and an "open-to-shut" valve cock located in said supply line and positioned within said passageway at the lower end of said curb box, the valve cock extending upwardly, the assembly including a positioning insert placed within the curb box at its lower end thereof, said insert comprising an upper, horizontally disposed plate having a central circular opening extending therethrough, said opening diameter sized to accommodate said valve body extending therethrough to a desired tolerance therebetween, so as to limit lateral movement of said valve body in any direction throughout 360° in the plane about said valve when said insert is installed, the insert having at least two vertically oriented legs extending from said upper plate downwardly such that, when installed, said legs straddle said supply line and valve body, wherein each of said legs has a foot member extending radially outwardly and, when installed, each foot member is positioned under the lowermost end of said curb box and is held in place thereat by said curb box, wherein, when installed, said insert prevents substantial movement, both laterally and vertically, of said valve body relative to said curb box, wherein said conduit comprises two sections, a top section and a bottom section, wherein said bottom section is threaded externally and said top section has internal, mating threads along at least a portion of its length which mate with the bottom section threads, the top section having a flange at its top thereof to mate with and detachably receive and secure said cover, and wherein said insert is fabricated as a single, unitary, injection molded, plastic component, thereby permitting ease of access to said valve cock by a valve key extending through said curb box to said valve.

17. A positioning insert for placement within a curb box at its lower end thereof, said insert comprising an upper, horizontally disposed plate having a central circular opening extending therethrough, said opening diameter sized to accommodate a valve body extending therethrough to a desired tolerance therebetween, so as to limit lateral movement of said valve body in any direction throughout 360° in the plane about said valve when said insert is installed, the insert having at least two vertically oriented legs extending from said upper plate downwardly such that, when installed, said legs straddle said valve body, wherein each of said legs has a foot member extending radially outwardly and, when installed, each foot member is positioned under the lowermost end of said curb box and is held in place thereat by said curb box, wherein, when installed, said insert prevents substantial movement, both laterally and vertically, of said valve body relative to said curb box.

18. The insert of claim 17 wherein said plate has a plurality of openings therethrough spaced about its periphery and between the central circular opening and the outer edge of said plate, to effect drainage therethrough.

19. The insert of claim 17 having more than two legs.

20. The insert of claim 17 fabricated of plastic.

21. The insert of claim 20 wherein said plastic is ABS plastic.

22. The insert of claim 20 wherein said plastic is PVC.

23. The insert of claim 20 wherein said plastic is a fluorocarbon plastic.

24. The insert of claim 23 wherein said plastic is PTFE.

25. The insert of claim 23 wherein said plastic is FEP.

26. The insert of claim 17 fabricated as a single, unitary component, including said upper plate, legs and feet.

27. The insert of claim 26 being injection molded.

28. The insert of claim 17 wherein the perimeter of said plate is circular in top plan view.

29. The insert of claim 17 wherein the perimeter of said plate is hexagonal in top plan view.

30. The method of use of the insert of claim 17 in maintaining alignment of a curb box and a service line valve located below ground level in order to facilitate access to said valve by a valve key from ground level.

* * * * *